US012257481B2

(12) United States Patent
Franceschelli et al.

(10) Patent No.: US 12,257,481 B2
(45) Date of Patent: Mar. 25, 2025

(54) WIND TOLERANT BALL

(71) Applicant: ZEpickleball Company LLC, St. Louis, MO (US)

(72) Inventors: Robert J. Franceschelli, St. Louis, MO (US); John J. Anderson, Alpine, CA (US); Wouter Remmerie, Antwerp (BE)

(73) Assignee: ZEpickleball Company LLC, St. Louis, MO (US)

( * ) Notice: Subject to any disclaimer, the term of this patent is extended or adjusted under 35 U.S.C. 154(b) by 0 days.

(21) Appl. No.: 18/534,874

(22) Filed: Dec. 11, 2023

(65) Prior Publication Data

US 2024/0189668 A1 Jun. 13, 2024

Related U.S. Application Data

(60) Provisional application No. 63/464,456, filed on May 5, 2023, provisional application No. 63/431,901, filed on Dec. 12, 2022.

(51) Int. Cl.
*A63B 37/14* (2006.01)
*A63B 37/00* (2006.01)

(52) U.S. Cl.
CPC ..... *A63B 37/14* (2013.01); *A63B 37/0098* (2013.01); *A63B 2225/01* (2013.01)

(58) Field of Classification Search
CPC . A63B 37/14; A63B 2225/01; A63B 37/0098; A63B 39/06; A63B 2043/001
See application file for complete search history.

(56) References Cited

U.S. PATENT DOCUMENTS 1,483,165 A * 2/1924 Eaton ..... A63B 69/3655 D30/160
2,307,182 A 1/1943 Young
(Continued)

FOREIGN PATENT DOCUMENTS

EM 001709940 5/2010
GB 2494966 A * 3/2013 ..... A63B 37/00
(Continued)

OTHER PUBLICATIONS

Sara Mateos Fernandez, Development of the Football, Department of Materials and Manufacturing Technology, Department of Materials and Manufacturing Technology, SE-41296 Gothenburg, Sweden. Retrieved from the Internet <URL: https://publications.lib.chalmers.se/records/fulltext/241131/241131.pdf>.
(Continued)

*Primary Examiner* — Steven B Wong
(74) *Attorney, Agent, or Firm* — Carmody MacDonald P.C.; Kevin C. Staed; Dennis JM Donahue, III

(57) ABSTRACT

The ball is a thin-walled hollow sphere that includes an array of apertures with dimples in a pattern that are concentric to the aperture array. Dimples are provided on the exterior surface of the ball between the apertures with the pattern and dimensions of the dimples varying based on proximity to the apertures. Internal protuberances are provided on the interior surface of the hollow ball such that the interior surface also manages aerodynamic airflow through the ball. Channels are also provided around each of the apertures within the ball which may intersect proximate dimples or be spaced therefrom. The ball also includes apertures having converging and diverging sidewalls that form a venturi shape to increase inflow air into the apertures and outflow air out of the apertures. Finally, the ball also maintains a weight:diameter ratio within a fixed range.

20 Claims, 11 Drawing Sheets

(56) References Cited

U.S. PATENT DOCUMENTS

| | | | | |
|---|---|---|---|---|
| 2,776,139 | A | 1/1957 | Blamey, Jr. et al. | |
| 3,908,994 | A * | 9/1975 | Astrom | A63B 43/00 473/613 |
| 4,256,304 | A * | 3/1981 | Smith | A63B 37/14 473/378 |
| 5,280,906 | A | 1/1994 | Vitale | |
| 5,564,708 | A | 10/1996 | Hwang | |
| 6,012,997 | A * | 1/2000 | Mason | A63B 43/00 273/DIG. 20 |
| 9,592,426 | B1 | 3/2017 | DiPietro | |
| D799,613 | S | 10/2017 | Dillon | |
| D800,236 | S | 10/2017 | Dillon | |
| 11,491,374 | B1 * | 11/2022 | Newcomb | A63B 43/06 |
| 2002/0193178 | A1 | 12/2002 | Saiz | |
| 2007/0281803 | A1 | 12/2007 | Jeong | |
| 2010/0216575 | A1 * | 8/2010 | Sato | A63B 37/0018 473/383 |
| 2011/0275463 | A1 | 11/2011 | Lim et al. | |
| 2014/0274465 | A1 | 9/2014 | Francis | |
| 2018/0264326 | A1 | 9/2018 | Simonutti et al. | |
| 2022/0088443 | A1 * | 3/2022 | Booz | A63B 43/04 |
| 2022/0338646 | A1 * | 10/2022 | McMullen | A47F 7/00 |

FOREIGN PATENT DOCUMENTS

| | | | | |
|---|---|---|---|---|
| SE | 200400675 | A * | 9/2004 | A63B 37/14 |
| WO | WO-2016034998 | A1 * | 3/2016 | A63B 43/04 |
| WO | WO-2017024427 | A1 * | 2/2017 | |
| WO | 2012126442 | | 9/2017 | |

OTHER PUBLICATIONS

Dura® Ball [online]. Onix Pickleball, Dec. 8, 2023. Retrieved from the Internet. < URL: https://www.onixpickleball.com/products/dura-fast-pickleballs>.

Franklin® Ball [online]. Pickleball Superstore.com, Dec. 8, 2023. Retrieved from the Internet. < URL: https://pickleballsuperstore.com/products/franklin-x-40-pickleball-12-qty>.

USA Pickleball Guidelines [online]. International Federation of Pickleball, 2021. Retrieved from the Internet <URL: https://usapickleball.org/docs/eec/Equipment-Standards-Manual.pdf>.

* cited by examiner

| | Weight (grams) 24 | Diameter (inches) D | Shell Thickness (inches) T | Weight:Diameter Ratio (W/D) 30 | Aperture Number 14 |
|---|---|---|---|---|---|
| USA Pickleball Guidelines* | 22.1-26.5 | 2.87-2.97 | 0.080-0.090 | 7.44-9.23 | 26-40 |
| DURA® Ball* | 25.8 | 2.89 | ≈0.085 | ≈8.93 | 40 |
| FRANKLIN® Ball* | 26.4 | 2.89 | ≈0.085 | ≈9.13 | 40 |
| WIND TOLERANT BALL (Range) | 27.0-52.0 | 2.50-3.50 | 0.062-0.175 | 9.3-20.8 | 26-40 |
| WIND TOLERANT BALL (Preferred Embodiment) | 32.6 | 2.90 | 0.106 | ≈11.24 | 32 |

*Prior Art

Fig. 3

WIND TOLERANT BALL

CROSS-REFERENCE TO RELATED APPLICATIONS

This application claims priority from U.S. Provisional Patent Application No. 63/431,901 filed on Dec. 12, 2022 and U.S. Provisional Patent Application No. 63/464,456 filed on May 5, 2023 which are both hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a ball, and more particularly to a ball which is less susceptible to the adverse effect of wind when traveling in windy conditions.

Related Art

Balls have been long been used for games, sports, exercise and various other activities with the general object of moving the ball from one point to another byway of throwing, hitting, paddling or otherwise propelling the ball in a certain direction. Numerous types of balls exist in the prior art and incorporate many different shapes, weights and constructions, yet there remains a desire to those in the art to provide an improved ball which is less susceptible to the adverse effect of wind when used in windy conditions.

Such a need is particularly relevant in the sport of pickleball which is often times played outdoors, in windy conditions. Pickleball is a racquet or paddle sport similar to tennis, badminton and ping-pong where players positioned on opposite sides of a small court and hit a light-weight hollow ball back and forth over a center net to score points. The game can be played both indoors and outdoors with the adverse impact that the wind can have on the flight characteristics of the ball being one of the unique challenges when playing outdoors. Given the relatively small size of a pickleball court and the lightweight nature of the ball used which is generally a thin-walled hollow sphere with an array of drilled holes, any headwind, tailwind, crosswind or other wind can significantly change the nature of the game, and strong winds can oftentimes make the game unplayable.

In use, current pickleballs, such as shown in U.S. Des. Pat. No. D800236 by Dillon, tend to be carried by the freestream air making the flight difficult to control by the player. For example, downwind trajectories tend to make the ball fly further, headwind trajectories tend to make the ball fly shorter and winds tend to move the ball off its original line of travel. Accordingly, there is a particular need in the sport of pickleball for a ball that is tolerant to the adverse effects of wind to facilitate playing pickleball outdoors where wind becomes a factor.

Numerous balls in the prior art have been designed to manage the aerodynamics during flight including, U.S. Pat. No. 5,564,708 by Hwang, US Pat. App. Pub. No. 20020193178 by Saiz, WIPO Application No. 2012126442 by Bergström and US Pat. App. Pub. No. 20130296085 by Parenti. The '708 Patent describes a golf ball with dimple dimensions and patterns that vary across the surface of the ball to alter air resistance, the '178 Application describes a golf ball with internal passageways that promote airflow through the ball, the '442 International Application describes compartments within the interior of a hollow ball to alter airflow therethrough and the '085 Application describes a ball with holes having an angled wall to draw more air into the ball. Furthermore, Sara Mateos Fernández discusses the aerodynamics of floorballs in her thesis titled Development of the Floorball published by the Department of Materials and Manufacturing Technology at Chalmers University of Technology and particularly discusses the use of a "venturi" shaped hole-wall design which produces a strangulation of airflow into and out of the ball.

Despite the various features incorporated into these prior art reference, the designs themselves are not holistic and generally focus on either airflow around a solid ball or through a hollow ball. Accordingly, there remains a need in the art for an improved ball that effectively promotes aerodynamic airflow around and through the ball such that freestream air more readily passes around the ball, as well as, through the ball to limit the adverse effect of the freestream air on the flight of the ball itself.

The relatively light weight of balls for pickleball and similar balls with a hollow construction further amplifies the effect of windy conditions when the balls are used therein. There is therefore another desire for a ball for pickleball that is marginally heavier and less susceptible to wind conditions but which still maintains the other qualities pickleball players recognize during play, including but not limited to bounce, compression and hardness. Furthermore, a heavier ball is also desirable for practice settings. Pickleball specific parameters for balls used in official pickleball matches and common balls in the prior art by DURA® and FRANKLIN® confirm to these guidelines as outlined the table shown in FIG. 3. Although a ball outside of the current guidelines will not be acceptable in official play recognized by USA Pickleball, windy conditions often times prevent play altogether such that a need for a wind tolerant ball with increased weight is desirable.

SUMMARY OF THE INVENTION

The invention is a wind tolerant ball that is less susceptible to the effects of wind during play and is particularly suited for the game of pickleball when played outdoors. The ball is heavier than similar balls in the prior art and has exterior and interior surfaces that are designed to manage and promote aerodynamic airflow around and through the ball such that freestream air more readily passes through the ball to limit the adverse effect of the freestream air on the flight of the ball during play. By managing the aerodynamic airflow on the outside surface of the ball in a manner to draw air around the ball and into the ball, and then treat the inner surface with similar aerodynamic features to assure good airflow out of the holes. This design concept effectively allows the freestream air to pass through the pickleball and the ball flight remains true.

The ball is a thin-walled hollow sphere that includes an array of apertures with dimples in a pattern that are concentric to the aperture array. Dimples are provided on the exterior surface of the ball between the apertures with the pattern and dimensions of the dimples varying based on proximity to the apertures. In one embodiment, the depth and diameter of the dimples decrease as the dimples are spaced further from the apertures whereas an alternative embodiment has larger dimples further from the aperture with the dimensions of the dimples decreasing in size as they get closer to the edge of the aperture.

In another aspect of the invention in the preferred embodiment, internal protuberances are provided on the interior surface of the shell such that the interior surface of the ball also manages aerodynamic airflow through the ball. The ball in the preferred embodiment therefore includes an independent yet synergistic combination of external dimples and interior protuberances that manage airflow on both the exterior and interior surfaces of the hollow ball.

In another aspect of the invention in the preferred embodiment, each aperture includes a converging and diverging sidewall having a "venturi" shape to increase inflow air into the apertures and outflow air out of the apertures. Thus, air is less likely to alter the course of the ball in flight as it is drawn in and drawn out from the hollow core.

This synergy of apertures, dimples and protuberances is intended to promote a true and consistent ball flight that is not as adversely affected by the prevailing wind acting on the ball during flight. Given the improvements in the aerodynamics of the ball, it will also minimize the influence of an excessive amount of top-spin or side-spin that is induced on the ball when propelled, such as by the paddle during the game of pickleball.

In one embodiment of the ball described herein the exterior surface of the ball includes a dimple pattern with varying dimple dimensions based on proximity to a corresponding aperture. Alternatively, the dimple dimensions and pattern may be uniform across the surface area of the ball. In another embodiment of the ball described herein, the exterior surface of the ball includes dimples for managing airflow around the ball while protuberances are provided on the interior surface of the shell. However, the preferred ball combines both inventive features.

In another embodiment of the ball described herein, a circumferential channel is situated around each hole and may either blend into the pattern of the dimples are be independent therefrom. The proximity of the channel to the apertures help promote turbulent airflow over and into the holes and thereby reduce drag.

Although intended for use in pickleball, it will be appreciated that the ball described herein could be used in any number of games, sports or similar settings. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 shows a ball parameter table of balls in the prior art and the ball according to the invention described herein.

DETAILED DESCRIPTION OF THE PREFERRED EMBODIMENTS

The following description of the preferred embodiment(s) is merely exemplary in nature and is in no way intended to limit the invention, its application, or uses.

The ball according to the invention described herein includes a shell with a hollow core, a plurality of apertures within the shell and a plurality of dimples on the exterior of the shell between the apertures. Alternative embodiments of the ball may also include internal protuberances extending from the interior surface of the shell, channels within the exterior surface of the shell that surround each of the apertures and angled aperture sidewalls that increase the flow of air into and out of the hollow core. Regardless of the particular embodiment, the ball is designed to be marginally heavier than similar balls in the prior art such that the ball is less susceptible to windy conditions during use.

Figure 1B:
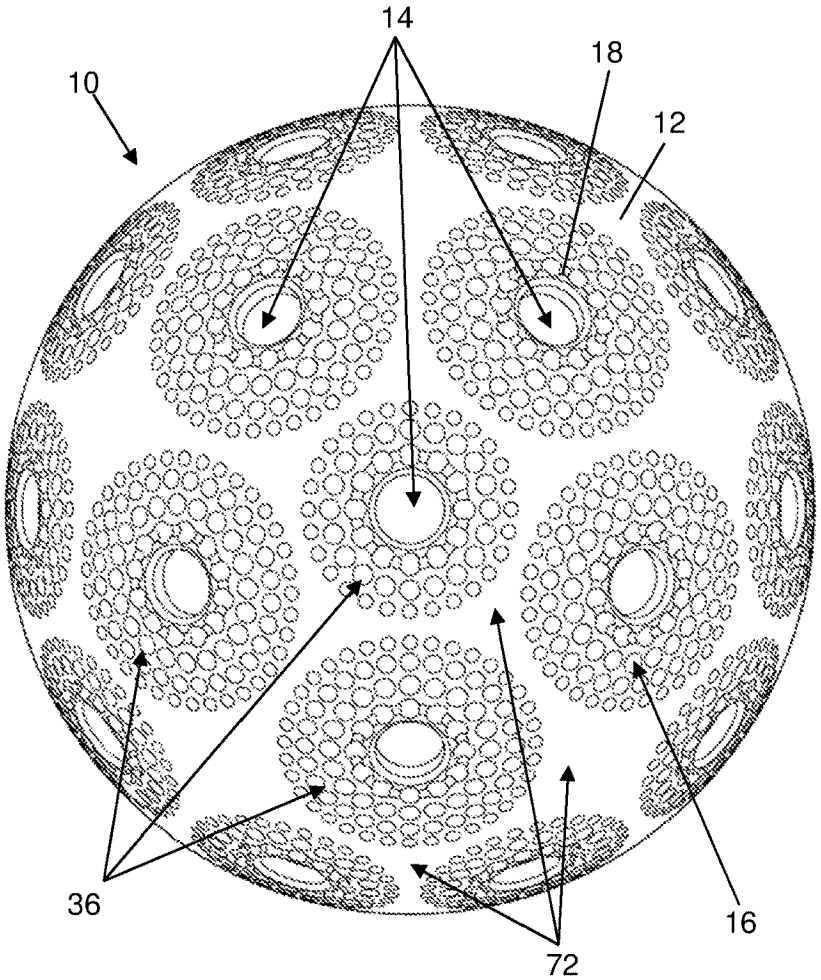
FIGS. 1A and 1B respectively show alternative embodiments of the exterior of the ball according to the invention described herein.
Figure 1A:
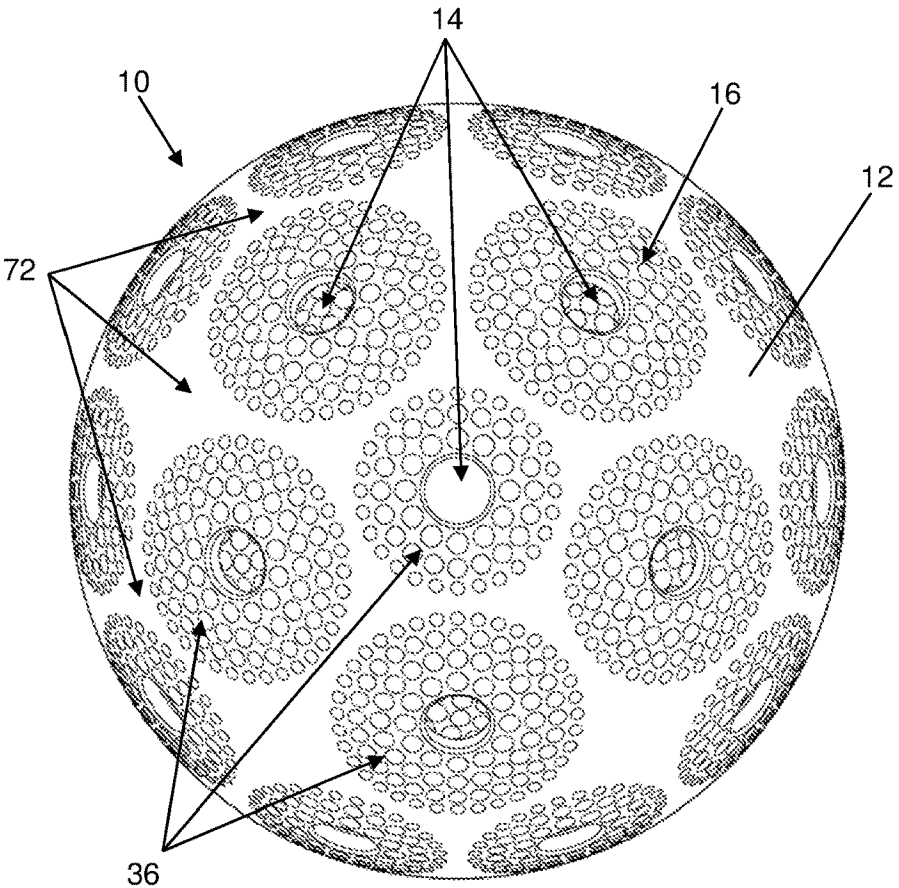
Figure 1C:
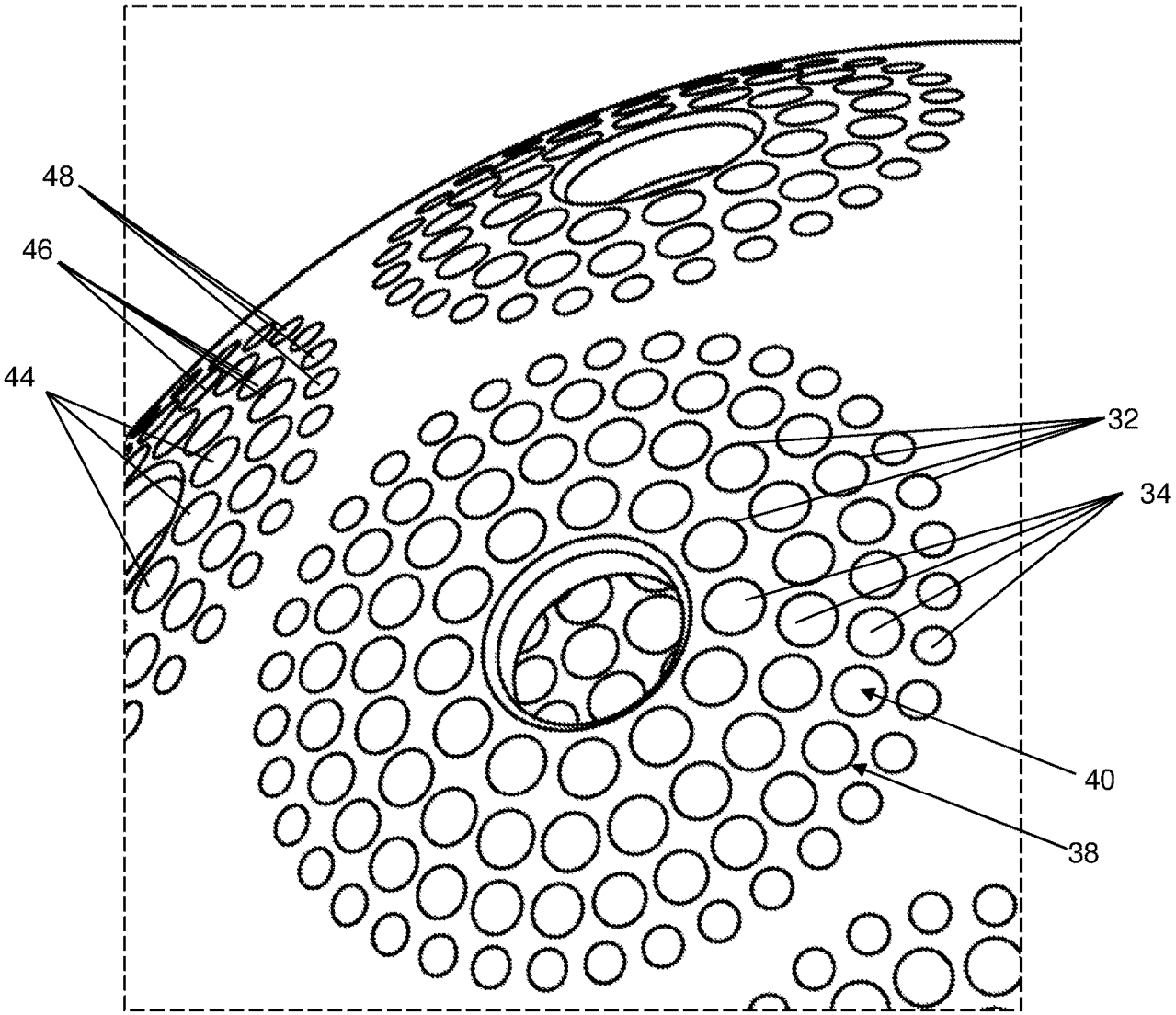
FIG. 1C is a detail view of the dimples on the exterior of the shell according to the invention described herein.
Figure 2B:
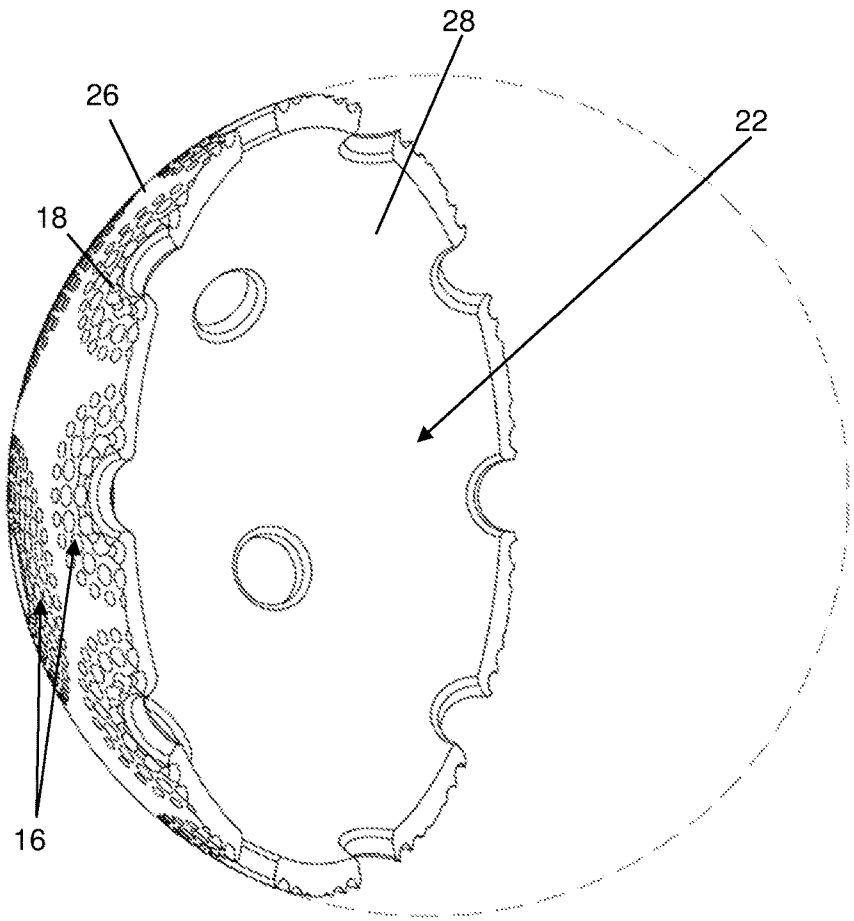
FIGS. 2A and 2B respectively show alternative embodiments of the interior of the ball according to the invention described herein.

As particularly shown in FIGS. 1 and 2, the ball 10 is a thin-walled sphere with shell 12 surrounding a hollow core 22, diameter ($D_S$) and thickness ($T_S$) between the exterior surface 26 and interior surface 28. Apertures 14 are spaced around the surface of the shell and are preferably circular in shape 38 with an exterior edge 50 within the exterior surface of the shell and an interior edge 52 within the interior surface of the shell. The opposing edges of the apertures are connected by a sidewall 54 extending the thickness of the shell. During use, air inflows and outflows through the various apertures as the ball travels through space. For example, as a ball travels through the air, at least some of the air is drawn through a first set of apertures into the hollow core as air within the core is drawn out from the another set of apertures.

As illustrated in the table shown in FIG. 3, USA Pickleball guidelines provide specific parameters for a balls weight 24, diameter (D) and thickness (T) and balls outside of the given ranges are nonconforming. Balls in the prior art fall squarely within the permitted weight range of twenty-two and one tenth grams and twenty-six and one half grams (22.1 g-26.5 g) and the permitted ball diameter range of two and eighty-seven hundredths of an inch and two and ninety-seven hundredths of an inch (2.87"-2.97"). Together, these permitted weight and diameter parameters establish a permitted weight:diameter ratio 30 range between seven and forty-forty hundredths and nine and twenty-three hundredths (7.44-9.23). In contrast to the balls in the prior art, it is an aspect of the ball described herein to be heavier with a higher weight:diameter ratio that may range between nine and three tenths and twenty and eight tenths (9.3-20.8). While maintaining this weight:diameter ratio, the ball according to the invention described herein can have a diameter between two and one half inches and three and one half inches (2.5"-3.5") and a weight between twenty-seven grams and fifty-two grams (27 g-52 g). Accordingly, the ball described herein is heavier than balls in the prior art and less susceptible to wind while still maintaining similar bounce, compression and speed when used during a game of pickleball as intended.

Persons having an ordinary skill in the art will appreciate that the weight of an object, such as a ball, can be altered in many fashions including changing materials and overall shape. Although the particular method of arriving at the aforementioned weight:diameter ratio is not intended to be limiting, one such method includes altering the relative thickness of the shell. For example, the wall thickness can be adjusted to add or subtract to the overall weight of the ball for a given diameter. According to the invention described herein, the wall thickness and ball diameter are designed in a way to assure the total mass of the ball is controlled. Furthermore, the number of apertures within the ball itself and relative dimensions of the dimples can also change the relative weight. The dimples are discussed in detail below and the preferred ball includes thirty-two (32) apertures as noted the table of FIG. 3.

The preferred wind tolerant ball according to the invention described herein has a thickness that ranges between sixty-two thousandths and one hundred and seventy-five thousandths of one inch (0.062"-0.175"). In the preferred embodiment of the ball, the weight is equal to thirty-two and six tenths of a gram (32.6 g), has a diameter equal to two and 9 tenths of an inch (2.9") and has a shell thickness equal to one hundred and six thousandths of an inch (0.106") which results in a weight:diameter ratio equal to eleven and twenty four hundredths (11.24).

On the exterior surface between the various apertures, dimples 16 are provided to further draw air around the ball and into the apertures within the shell. Each dimple includes a perimeter edge 32, which is preferably circumferential, and a depression 34 recessed a depth (Ra) from the exterior surface of the shell. The depression may be a concave hemispherical shape 40 or take another geometric shape without departing from the inventive aspects of the ball described herein. Furthermore, it will be appreciated that the shape of the perimeter edge of each dimple may not necessarily be circumferential and instead could be any number of other shapes.

Dimples may cover the entirety of the exterior surface of the ball but the preferred embodiments shown in FIGS. 1 and 2 include regionalized groups of the dimples surrounding a corresponding aperture that are spaced from one another on the exterior of the shell. Each group of dimples 36 concentrically surround each of the apertures within the ball and lands 72 on the exterior surface of the ball having no dimples space the groups from one another. Accordingly, the respective groups of dimples are spaced lengths ($L_1$, $L_2$ and $L_3$) from the correspond aperture they surround. In either embodiment, the dimples help to direct airflow around the ball to reduce drag as well as promote airflow into and out of the holes in the ball making the ball fly through the freestream air with minimal adverse effects from prevailing wind speed and direction.

The dimples on the exterior of the shell are furthered patterned to include sets within each group that in the preferred embodiment change dimensions in relation to a particular sets' proximity to the corresponding aperture. More particularly, each series of dimples includes a proximal set 44 of dimples that are most proximate to the corresponding aperture, a distal set 48 of dimples that are most distal from the corresponding aperture and at least one middle set 46 of dimples that are positioned between the proximal and distal dimples. To promote proper airflow into and around the ball, at least some of the dimples differ in diameter ($D_d$) or recess depth between the respective sets within in a group.

Like the dimples on the exterior surface of the shell, the preferred embodiment also includes protuberances 20 on the interior surface of the shell that project into the hollow core to manage airflow within the core of the ball in a similar fashion to the dimples on the exterior of the ball. The protuberances, best shown in FIGS. 2C, each have a perimeter base 58 and a peak 60 that is spaced a height ($H_p$) from the interior surface. As with the dimples discussed above, the protuberances cover the interior surface of the shell but can be regionalized into groups of protuberances 56 that surround a corresponding aperture with subsets that vary in dimension based on their proximity to the corresponding aperture. Thus, like the proximal, distal and middle sets of dimples, the protuberances can also be defined into a proximal set 62 of protuberances that are closest to a corresponding aperture, a distal set 66 of protuberances that are furthest away from a corresponding aperture and a middle set 64 of protuberances that are spaced between the proximal and distal protuberances.

Figure 5B:
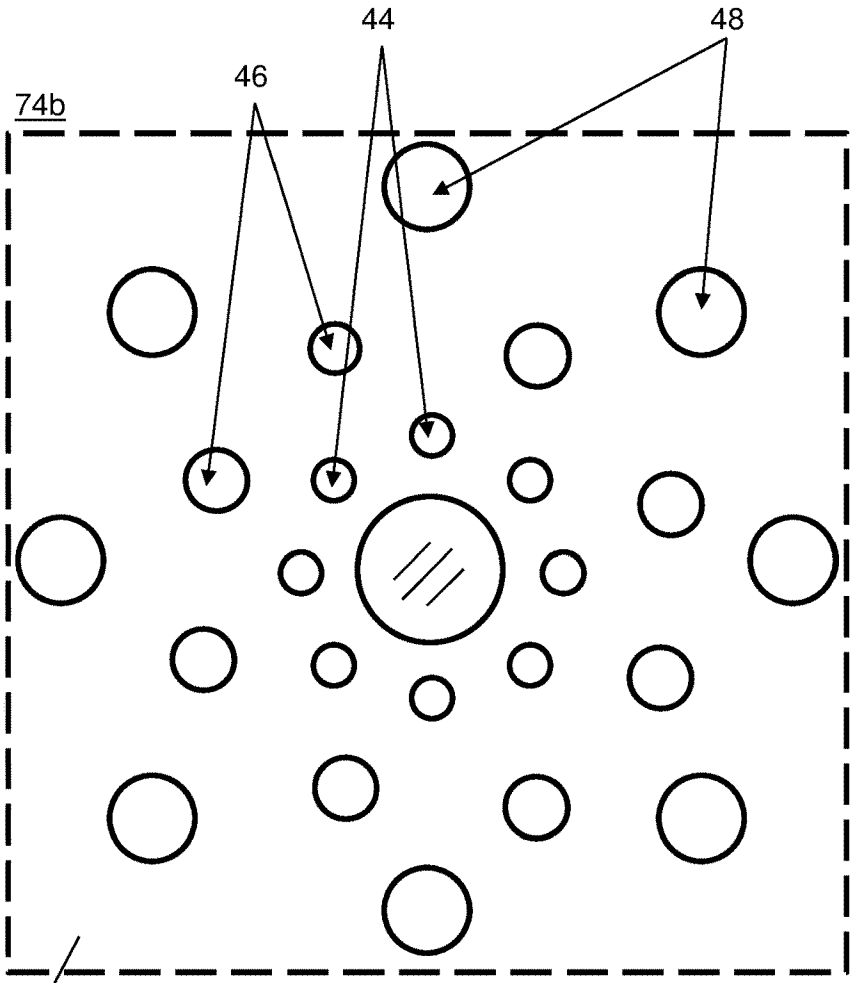
FIG. 5A-5C are illustrative plan views of dimple and protrusion patterns according to the invention described herein.
Figure 5A:
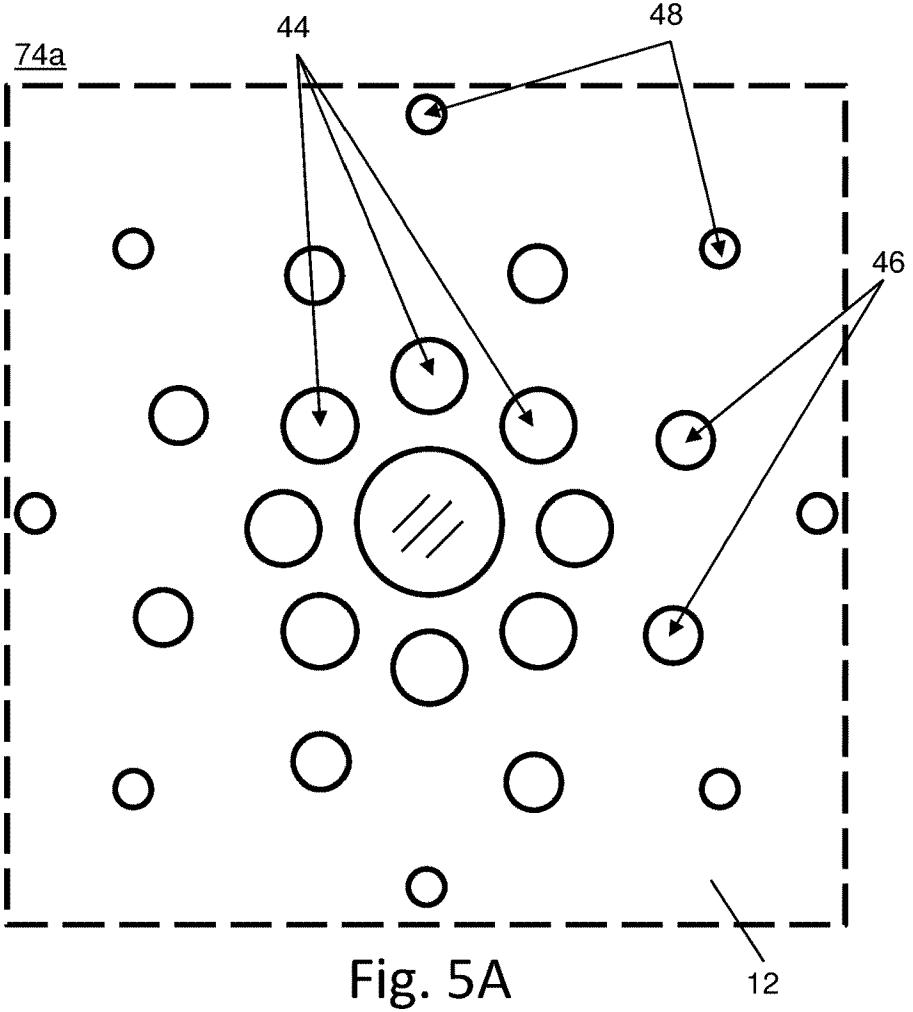
Figure 5C:
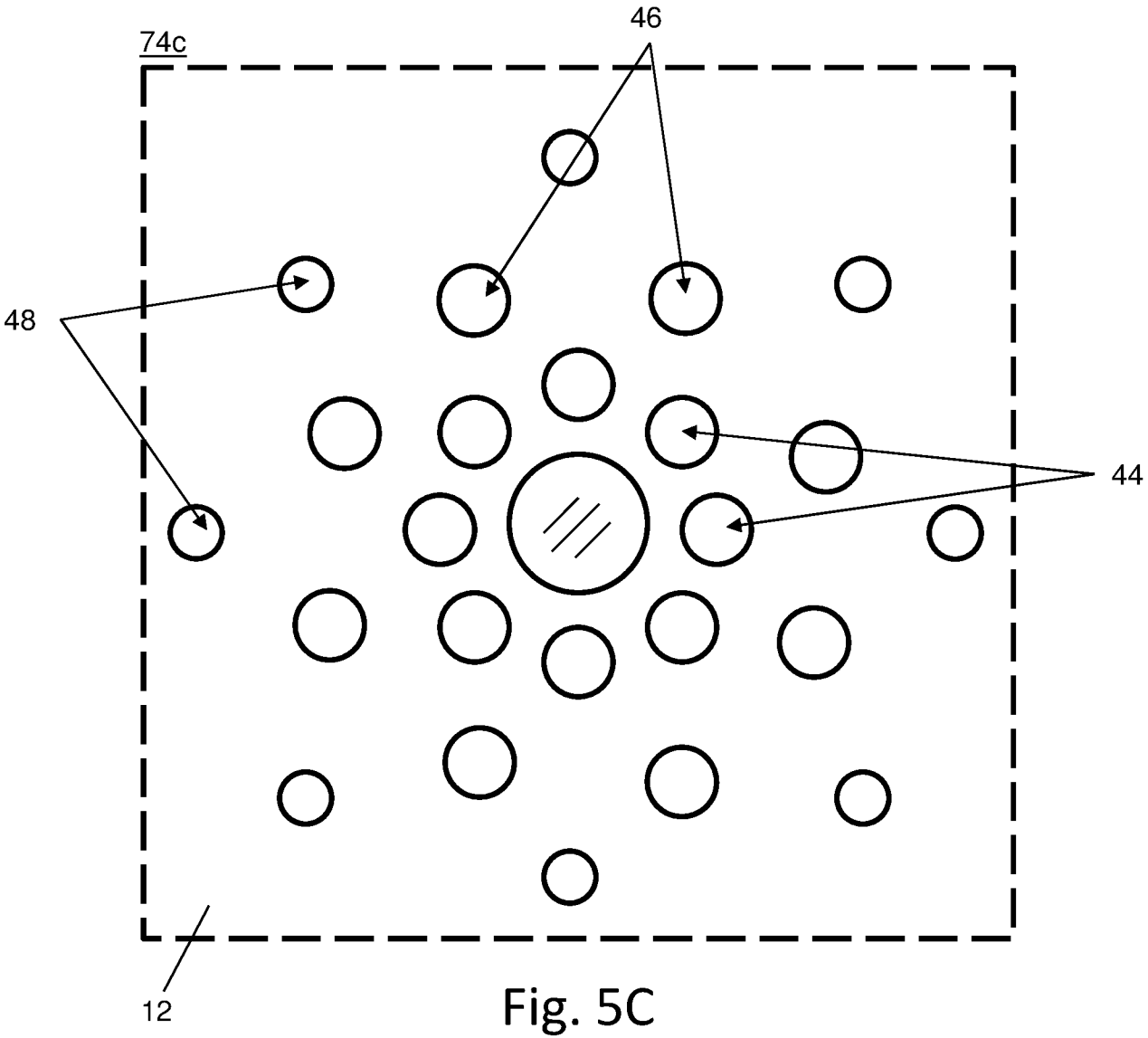

As shown in FIGS. 5A, 5B and 5C which illustrate alternative dimple and protuberance patterns respectively positioned on the exterior and interior of a ball, the size of the dimples and protuberances preferably vary relative to their proximity to the corresponding apertures. FIGS. 5A, 5B and 5C and the details below make particular reference to the relative dimensions of the perimeter and recessions of the dimples on the exterior of the shell but it will be appreciated that the same principles apply to the bases and peaks of the protuberances on the interior surface of the shell.

As shown in FIG. 5A, the dimples may decrease in diameter from the proximal set to the distal set with the diameter of the proximal set being the largest and the diameter of the distal set being the smallest in a descending pattern 74*a*. Conversely, as shown in FIG. 5B, the dimples may increase in diameter from the proximal set to the distal set with the diameter of the proximal set being the smallest and the diameter of the distal set being the largest in an ascending pattern 74*b*. Further still, the dimples may have an irregular pattern 74*c* as shown in FIG. 5C with the diameter of the middle set and the proximal set being equal and both larger than the distal set. These relative diameters of the dimples vary based on proximity to the corresponding aperture and are preferably less than the diameter of the apertures. Accordingly, the preferred pattern is not fixed and can vary from embodiment to embodiment with the middle set being different from at least one of the proximal set and the distal set in either diameter or recess depth such that the dimensions are not uniform across all of the dimples within a group.

Figures 4A, 4B, 4C, 4D:
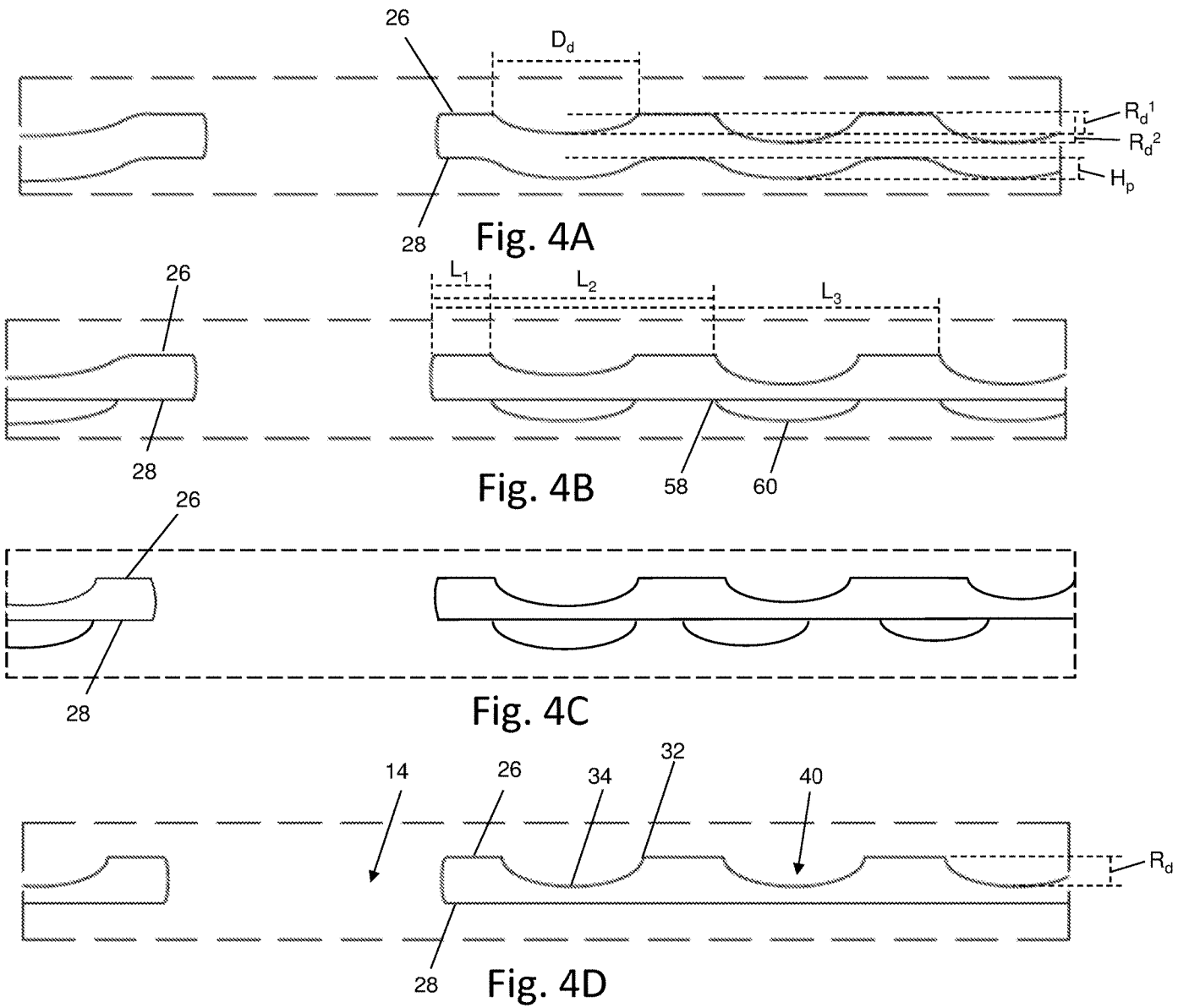
FIGS. 4A-4D are illustrative cross-sectional views of alternative dimple and protrusion configurations according to the invention described herein.

As the diameters of the dimples vary relative to their proximity to a corresponding aperture, the depth of the recession in the dimple can also vary. For example, the closest dimples to the aperture may be the shallowest ($R_d^1$) while the furthest dimples are the deepest ($R_d^2$) as shown in FIG. 4A. Alternatively, the dimples most proximate to the aperture may have the greatest depth and subsequently become shallower as the dimples are further spaced from the aperture.

Further still, in another alternative embodiment, the depth of the dimple may be the only dimension that changes relative to the dimple's proximity to a corresponding aperture. In this alternative embodiment, the diameter of the perimeter edge would remain the same while the depth changes. Similarly, another alternative embodiment may have dimples with unfirm depths wherein only the diameters vary relative to the dimple's proximity to the aperture. Finally, it will be appreciated that another embodiment may have uniform dimples that have the same dimensions across the surface of the ball and same pattern regardless of proximity to apertures within the hole. These alternative embodiments for the dimple patterns could be incorporated with protuberances having any one of the varying patterns discussed with reference to the dimples on the interior surface of the shell or the interior of the shell could be smooth, devoid of any protuberances.

It will be appreciated that the examples shown in FIGS. 4 and 5 are limited to a single dimple and protuberance groups surrounding one aperture and a person having an ordinary skill in the art would appreciate that these patterns will be extended across the surfaces of the ball to the other apertures therein. Thus, because apertures are spread across the entire surface of the ball, some dimples and protuberances may be included in multiple groups of dimples and protuberances based on proximity to adjacent apertures in some embodiments.

Figure 2A:
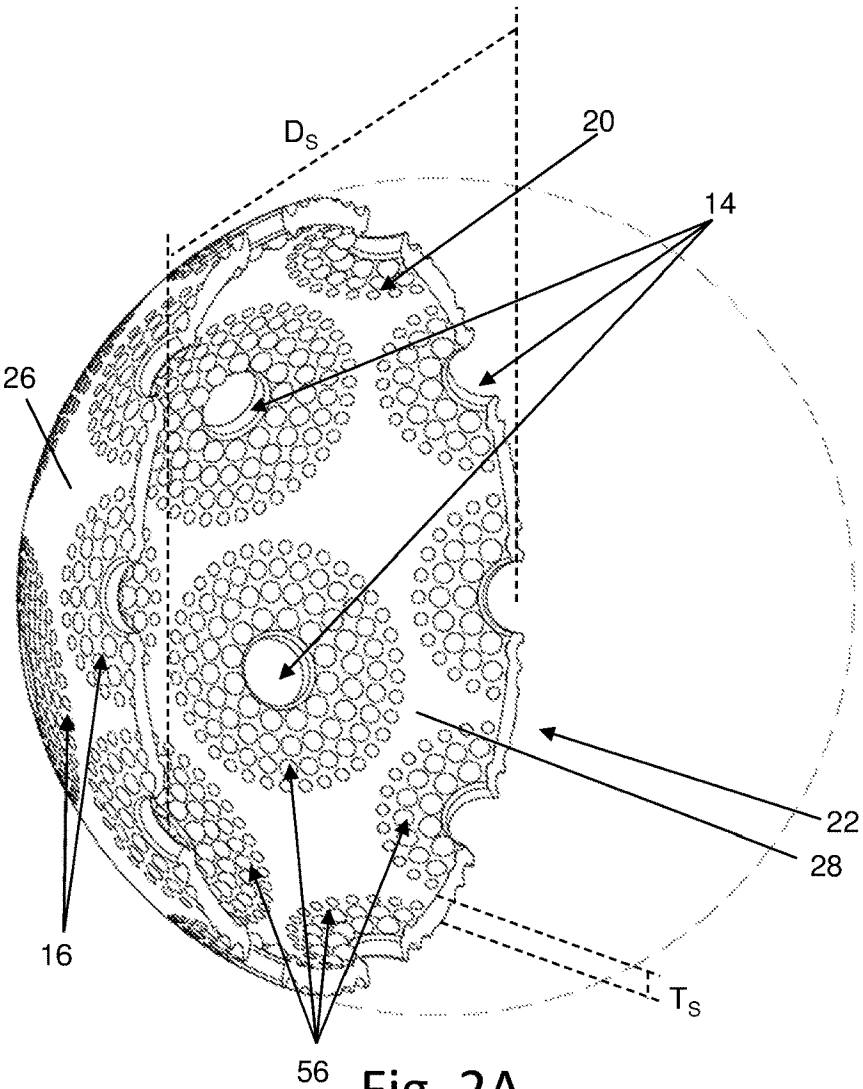
Figure 2C:
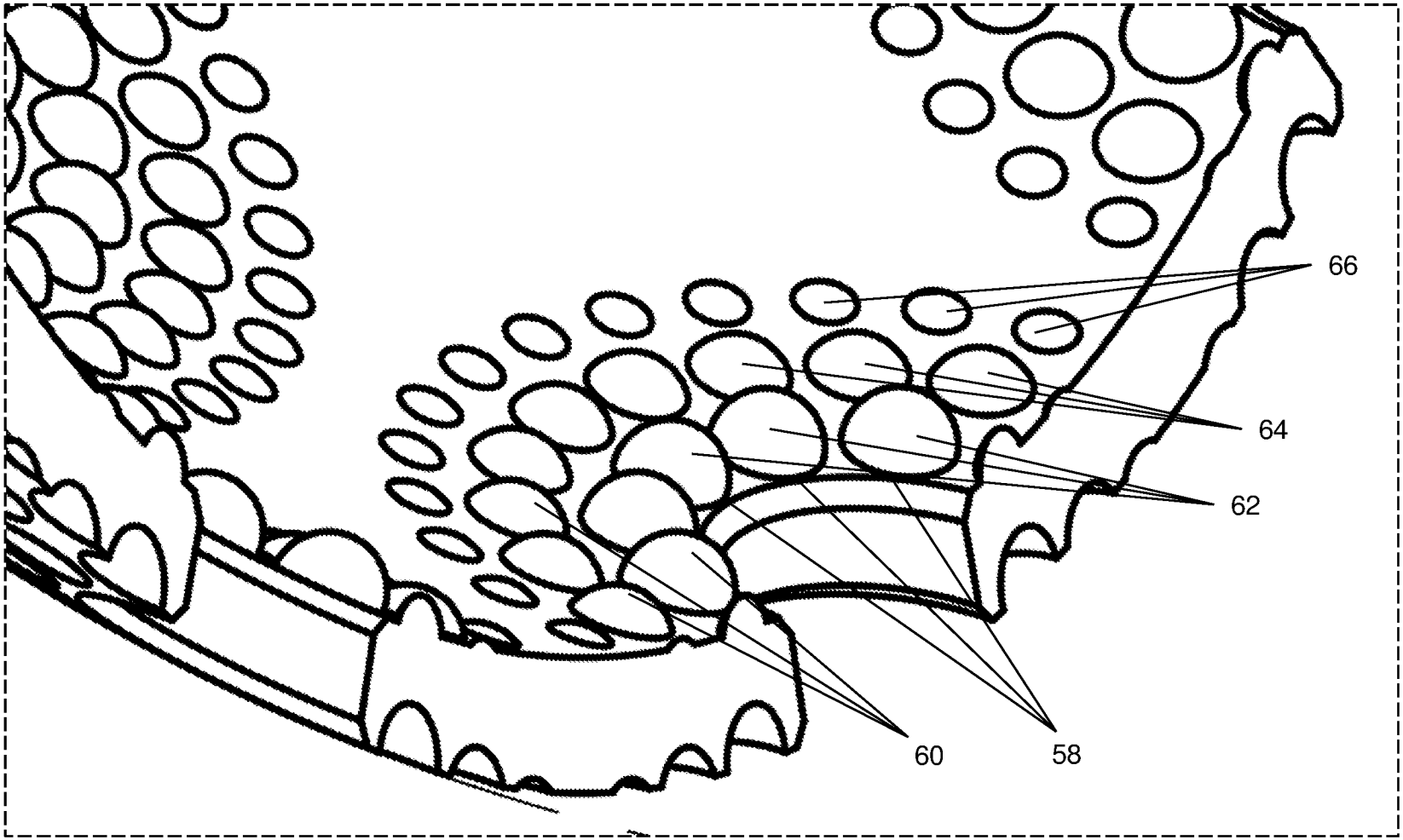
FIG. 2C is a detail view of the protuberances on the interior of the shell according to the invention described herein

Lands are found between the adjacent dimples and protuberances on the exterior and interior of the shell. Considering the size of the dimples and protuberances vary, the spacing between the various sets will also vary such that the spacing between the proximal set, middle set and distal sets are all unequal. As shown in FIGS. 1A and 2A, the lands formed by the spaces between the dimples, or protuberances, will vary relative to the dimensions of the perimeter of the dimples and the base of the protuberances. Collectively, the surface area of the apertures and the lands will form a first exterior surface area and first interior surface area of the ball while the recessions of the dimples and peaks of the protuberances respectively form a second exterior surface area and second interior surface area of the ball with the surface areas formed by the depressions and peaks which in the preferred embodiment is greater than the surface area formed by the lands and apertures. However, in embodiments with only regional dimples, the lands between the dimple or protuberance regions may be larger such that the surface area of the lands and apertures is greater than the surface area of the dimples or protuberances.

In the preferred embodiment of the ball described herein which combines the innovative dimple pattern with the innovative internal protuberances, it will be understood that the cooperative relationship between the dimples and the protuberances can be linked or disconnected without departing from the innovative aspects of each feature. For example, FIG. 4A illustrates an embodiment with a uniform shell thickness where the depressions of the dimples recessed into the interior of the shell define the peaks of the protuberances. Alternately, FIGS. 4B and 4C show disconnected depressions and protuberances with peaks protruding from the interior surface. Because these protuberances are not formed by the recessed dimples, they may have a different pattern all together with the dimples being offset from the protuberances, such as illustrated in FIG. 4C. In an alternative embodiment, the interior of the shell can be a smooth surface devoid of any protuberances as illustrated in FIG. 4D.

As noted herein, the preferred ball includes the innovative exterior pattern as well as the innovative protuberances within the interior but it will be understood that each embodiment are in and of themselves distinct and inventive. For example, a ball with the inventive dimple pattern that is devoid of interior protuberances also improves over the balls in the prior art. Similarly, a ball having a uniform collection of dimples across the surface area of the exterior of the ball in combination with the interior protuberances offers an improvement over balls in the prior art.

In addition to the dimples within the exterior surface of the shell, channels 18 may also be provided. The circumferential channel is provided around the respective apertures to help promote turbulent flow over and into the holes, thereby reducing drag. Each channel includes a pair of opposing top edges 68 within the surface of the shell and a recessed base 70 that is recessed a channel depth ($R_c$) from the opposing top edges within the exterior of the shell. As with the dimples and protuberances discussed above, the relative dimensions of the channel may vary based on the size of the ball and environmental conditions in which the ball is intended to be used, such as ball speed and wind conditions.

Figure 6A:
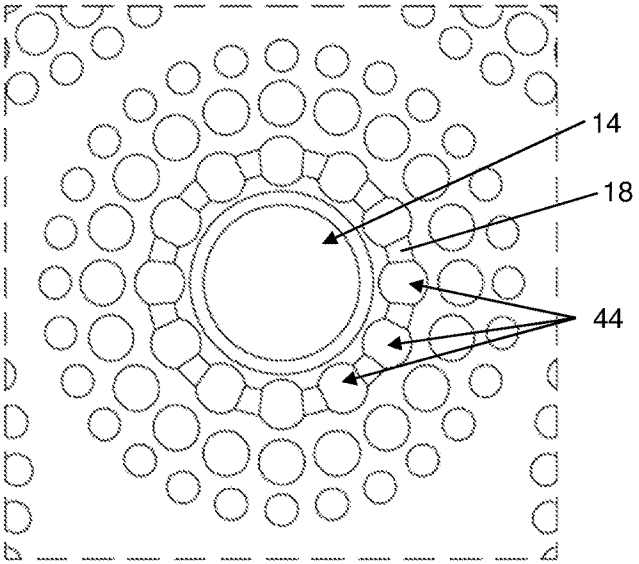
FIGS. 6A and 6B are detail views of the circumferential channel according to an embodiment of the invention described herein.
Figure 6B:
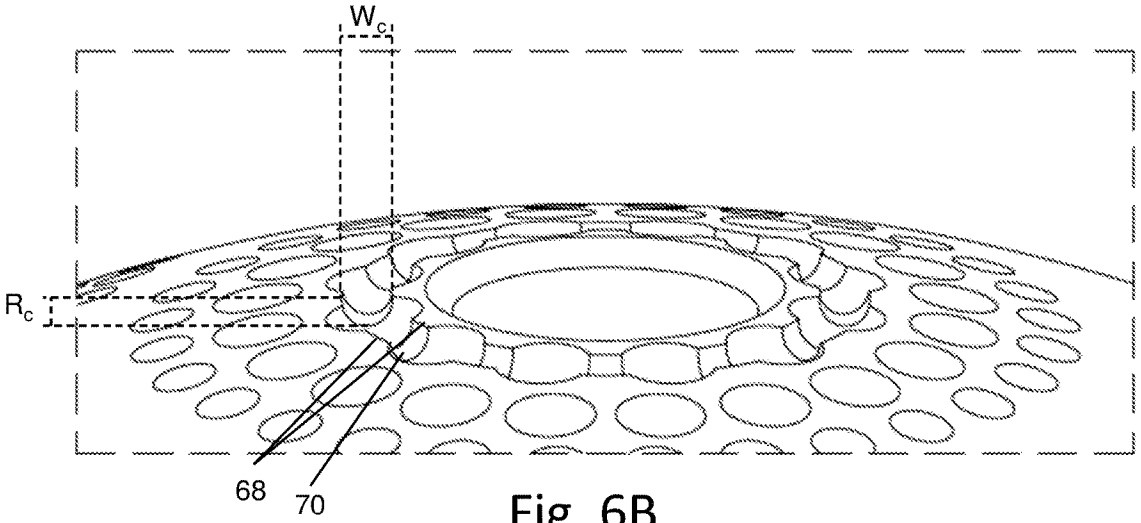

In the embodiments shown in FIGS. 6A and 6B, the channel intersects with the series of dimples most proximate to the aperture and may have a channel depth that is equal to the dimple depth of the respective dimples. Alternatively, the channel depth may be less than or greater than the dimple depth such that the base of the channel does not need to align with the recessed portion of the dimples which it intersects. Regardless of the channel depth, in embodiments with a channel intersecting proximate dimples, the width of the channel ($W_c$) between the opposing edges of the channel is less than the diameter of the dimples and the outer edge of each dimple protrudes outside the edges of the channel.

Figure 7:
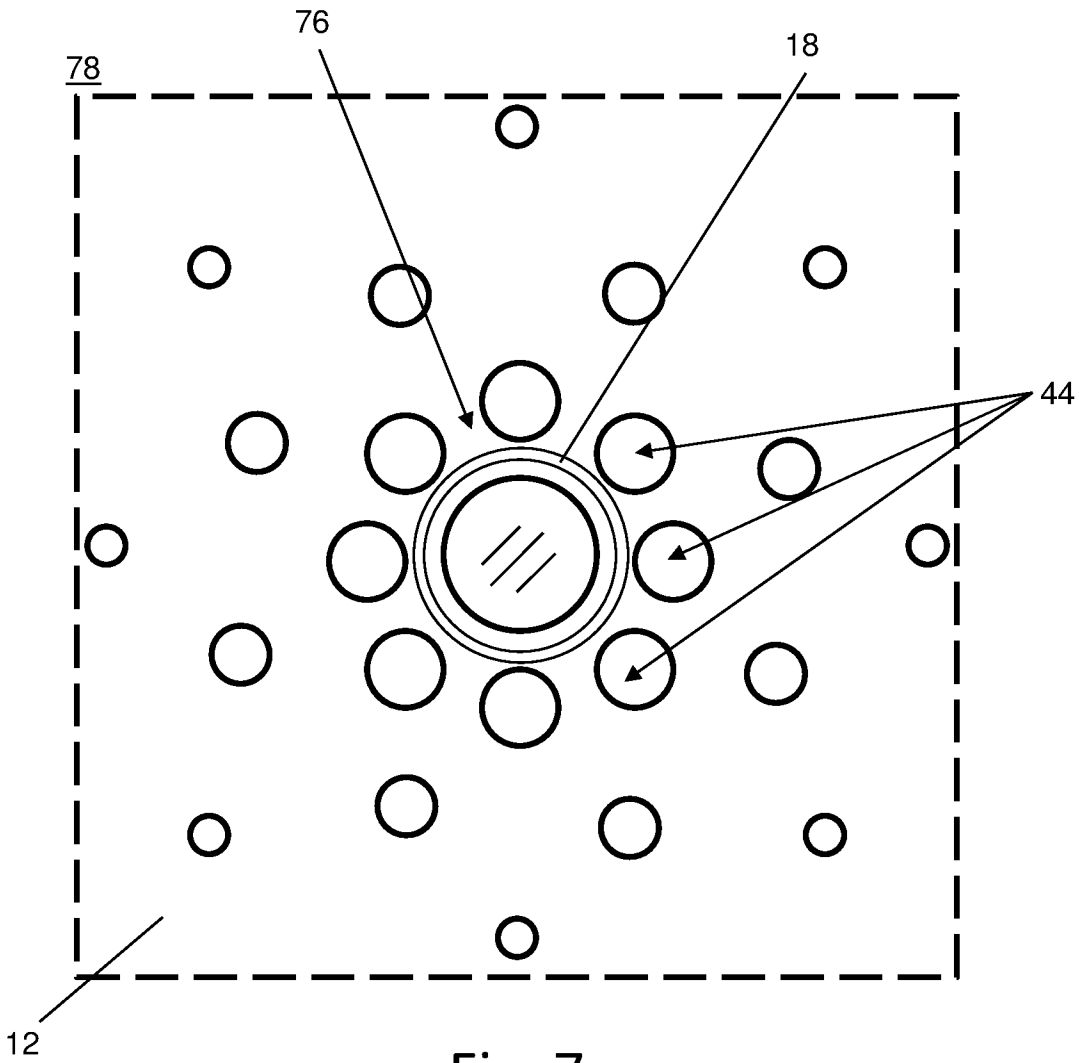
FIG. 7 is an illustrative plan view of a ball with an alternative circumferential channel according to the invention described herein.

In the alternative embodiment shown in FIG. 7, the channel may be removed from the dimples 78 and positioned at a location 76 between the outer periphery of the aperture and the proximate dimple without intersecting any of the dimples on the surface of the ball. In this embodiment, the space between the channel edges may be greater than, less than or equal to the diameter of any one of the dimples in comparison to the channels that intersect proximate dimples that cannot be wider than the diameter of the dimple.

In addition to impacting the airflow around and through the ball as explained above, the surface features described herein also have a deliberate impact on acoustic performance of the ball. The surface features include various elements, such as the dimples and a chamfer at the edge of the holes, to disrupt the laminar flow around the ball when struck with a paddle or racquet as well as when traveling through the air. One of the primary sources of the sound generated by the ball moving through the air is the shearing action of the air right at the edge of the hole which acts as a whistle. The hole edge treatment and surface dimples are effective in attenuating the sound generated by disrupting the boundary layer of air near the holes, and by eliminating the sharp edge of the holes. As well, the protrusions on the inner surface as described disrupt the air flow and attenuate any potential noise generated by air flowing out of the holes such that sound is further reduced in balls that have internal protuberances on the interior surface of the shell.

Figure 8B:
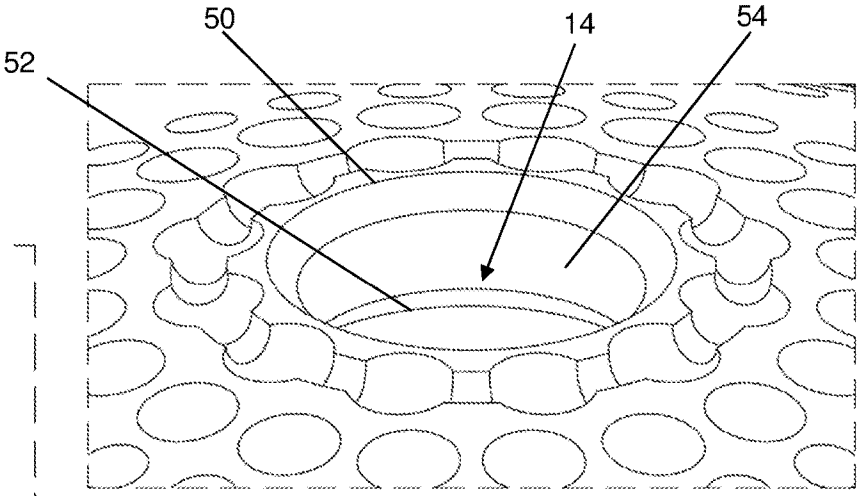
FIGS. 8A-8C are detail views of an aperture within the ball according to the invention described herein.
Figure 8C:
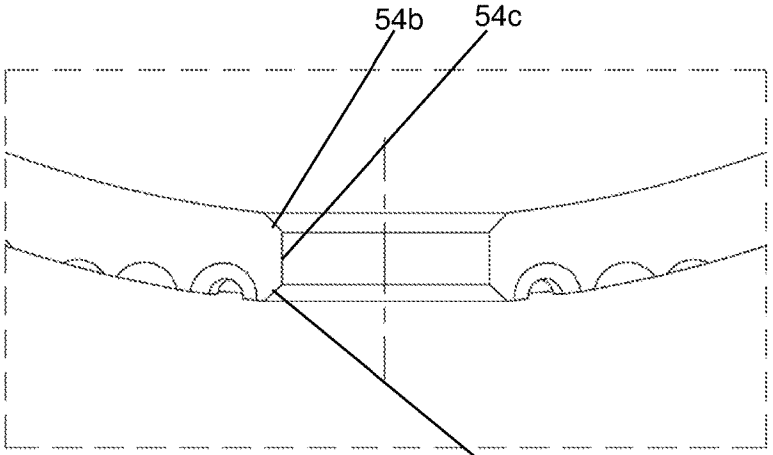
Figure 8A:
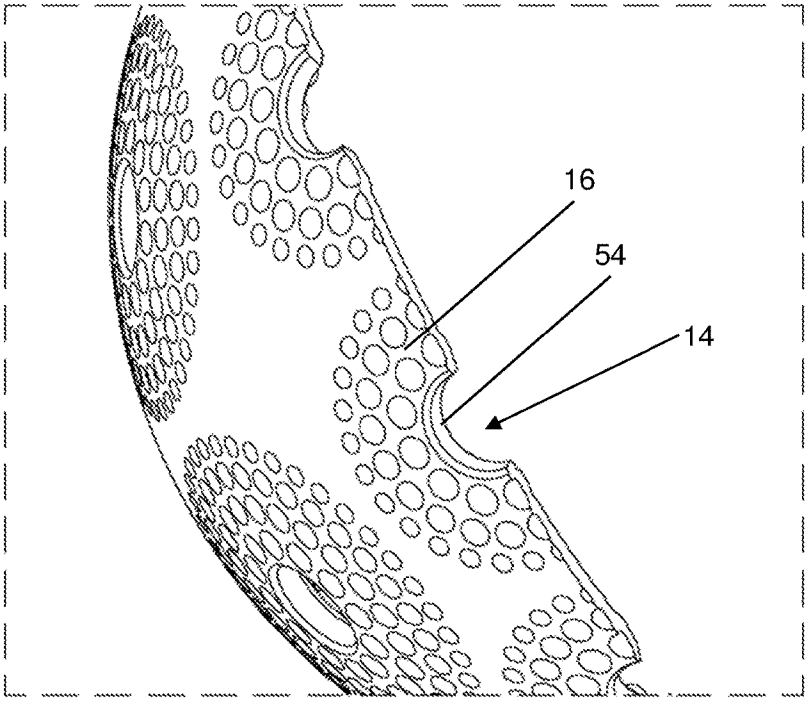

In the preferred embodiment of the apertures shown in FIGS. 8A-8C, the sidewalls of each aperture increase the amount of air drawn into and out of the ball byway of angled segments that converge and diverge at an inflection. The sidewall of each aperture includes a first segment 54*a* extending from the exterior edge to an inflection 54*c* proximate to the midpoint of the sidewall and a second segment 54*b* extending from the interior edge to the inflection. Thus, the sidewall is not straight between the opposing edges and instead angles inward from the respective edges to the inflection.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A ball, comprising:

a shell comprising a hollow core, a diameter, a weight, a thickness between an exterior surface and an interior surface exterior surface and a weight:diameter ratio between the weight and the diameter, wherein the weight is between 27 and 52 grams, wherein the diameter is between 2.5 and 3.5 inches and wherein the weight:diameter ratio is between 9.3 and 20.8;

a plurality of apertures within the exterior surface; and a plurality of dimples on the exterior surface, wherein each dimple comprises a perimeter edge along the exterior surface and a depression recessed a dimple depth from the perimeter edge into the exterior surface, and wherein a group of dimples from the plurality of dimples concentrically surround each of the plurality of apertures.

2. The ball of claim 1 further comprising a plurality of circumferential channels respectively surrounding each of the apertures, wherein each circumferential channel comprises a pair of opposing edges along the exterior surface and a base recessed a channel depth from the opposing edges into the exterior surface of the shell.

3. The ball of claim 2, wherein the perimeter edge of each of the plurality of dimples further comprise a circumferential shape and a dimple diameter, and wherein the depression of each of the plurality of dimples further comprises a hemispherical shape.

4. The ball of claim 3, wherein each of the circumferential channels intersect a respective set of dimples from the group of dimples concentrically surrounding each of the plurality of apertures, wherein the opposing edges are spaced by a channel width, wherein the channel width is less than the dimple diameter of the respective set of dimples, and wherein the channel depth is no greater than the dimple depth of the respective set of dimples.

5. The ball of claim 1, wherein the group of dimples further comprise a proximal set of dimples, a distal set of dimples, and a middle set of dimples, wherein the proximal set of dimples are situated proximate to the corresponding aperture, wherein the distal set of dimples are spaced a distance away from the proximal set of dimples opposite from the corresponding aperture, and wherein the middle set of dimples are situated between the proximal set of dimples and the distal set of dimples.

6. The ball of claim 5, wherein at least one of the dimple diameter and the dimple depth of the middle set of dimples are unequal to the respective dimple diameter and the respective dimple depth of at least one of the proximal set of dimples and the distal set of dimples.

7. The ball of claim 1, wherein each of the apertures further comprises an exterior edge and an interior edge connected by a sidewall, wherein the exterior edge connects to the exterior surface, wherein the interior edge connects to the interior surface, wherein the sidewall comprises a first segment, a second segment and an inflection between the first segment and the second segment, wherein the first segment is angled between the inflection and the exterior edge, and wherein the second segment is angled between the inflection and the interior edge.

8. The ball of claim 1 further comprising a plurality of protuberances on the interior surface of the shell, wherein a group of protuberances from the plurality of protuberances concentrically surround each of the plurality of apertures on the interior surface, and wherein each protuberance comprises a perimeter base along the interior surface and a peak protruding a height from the perimeter base into the hollow core.

9. The ball of claim 1, wherein the plurality of apertures are less than 40, wherein the exterior surface of the shell further comprises a plurality of lands between the respective group of dimples surrounding the respective plurality of apertures, wherein the group of dimples collectively define a first surface area on the exterior of the shell, wherein the plurality of lands collectively define a second surface area on the exterior of the shell, and wherein the first surface area is larger than the second surface area, and wherein the diameter is between 2.7 and 3.1 inches.

10. The ball of claim 1, wherein the diameter is between 2.87 and 2.97 inches.

11. A ball, comprising:

a shell comprising a hollow core, a diameter, a thickness between an exterior surface and an interior surface exterior surface;

a plurality of apertures within the exterior surface;

a plurality of dimples on the exterior surface, wherein each dimple comprises a circumferential perimeter edge along the exterior surface, a dimple diameter and a depression recessed a dimple depth from the perimeter edge into the exterior surface, and wherein a group of dimples from the plurality of dimples concentrically surround each of the plurality of apertures; and a plurality of circumferential channels respectively surrounding each of the apertures, wherein each circumferential channel comprises a pair of opposing edges along the exterior surface and a base recessed a channel depth from the opposing edges into the exterior surface of the shell.

12. The ball of claim 11, wherein each of the circumferential channels intersect a respective set of dimples from the group of dimples concentrically surrounding each of the plurality of apertures, wherein the opposing edges are spaced by a channel width, wherein the channel width is less than the dimple diameter of the respective set of dimples, and wherein the channel depth is no greater than the dimple depth of the respective set of dimples.

13. The ball of claim 11, wherein the group of dimples further comprise a proximal set of dimples, a distal set of dimples, and a middle set of dimples, wherein the proximal set of dimples are situated proximate to the corresponding aperture, wherein the distal set of dimples are spaced a distance away from the proximal set of dimples opposite from the corresponding aperture, wherein the middle set of dimples are situated between the proximal set of dimples and the distal set of dimples, and wherein at least one of the dimple diameter and the dimple depth of the middle set of dimples are unequal to the respective dimple diameter and the respective dimple depth of at least one of the proximal set of dimples and the distal set of dimples.

14. The ball of claim 11, wherein each of the apertures further comprises an exterior edge and an interior edge connected by a sidewall, wherein the exterior edge connects to the exterior surface, wherein the interior edge connects to the interior surface, wherein the sidewall comprises a first segment, a second segment and an inflection between the first segment and the second segment, wherein the first segment is angled between the inflection and the exterior edge, and wherein the second segment is angled between the inflection and the interior edge.

15. The ball of claim 11 further comprising a plurality of protuberances on the interior surface of the shell, wherein a group of protuberances from the plurality of protuberances concentrically surround each of the plurality of apertures on the interior surface, and wherein each protuberance comprises a perimeter base along the interior surface and a peak protruding a height from the perimeter base into the hollow core.

16. The ball of claim 11, wherein the shell further comprises a weight and a weight:diameter ratio between the weight and the diameter, wherein the weight is between 27 and 52 grams, wherein the diameter is between 2.5 and 3.5 inches and wherein the weight:diameter ratio is between 9.3 and 20.8.

17. A ball, comprising:

a shell comprising a hollow core, a diameter, a thickness between an exterior surface and an interior surface exterior surface;

a plurality of apertures within the exterior surface;

a plurality of dimples on the exterior surface, wherein each dimple comprises a circumferential perimeter edge along the exterior surface, a dimple diameter and a depression recessed a dimple depth from the perimeter edge into the exterior surface, and wherein a group of dimples from the plurality of dimples concentrically surround each of the plurality of apertures; and a plurality of protuberances on the interior surface of the shell, wherein a group of protuberances from the plurality of protuberances concentrically surround each of the plurality of apertures on the interior surface, and wherein each protuberance comprises a perimeter base along the interior surface and a peak protruding a height from the perimeter base into the hollow core.

18. The ball of claim 17 further comprising a plurality of circumferential channels respectively surrounding each of the apertures on the exterior surface, wherein each circumferential channel comprises a pair of opposing edges along the exterior surface and a base recessed a channel depth from the opposing edges into the exterior surface of the shell, wherein each of the circumferential channels intersect a respective set of dimples from the group of dimples concentrically surrounding each of the plurality of apertures, wherein the opposing edges are spaced by a channel width, wherein the channel width is less than the dimple diameter of the respective set of dimples, and wherein the channel depth is no greater than the dimple depth of the respective set of dimples.

19. The ball of claim 17, wherein each of the apertures further comprises an exterior edge and an interior edge connected by a sidewall, wherein the exterior edge connects to the exterior surface, wherein the interior edge connects to the interior surface, wherein the sidewall comprises a first segment, a second segment and an inflection between the first segment and the second segment, wherein the first segment is angled between the inflection and the exterior edge, and wherein the second segment is angled between the inflection and the interior edge.

20. The ball of claim 17, wherein the shell further comprises a weight and a weight:diameter ratio between the weight and the diameter, wherein the weight is between 27 and 52 grams, wherein the diameter is between 2.5 and 3.5 inches and wherein the weight:diameter ratio is between 9.3 and 20.8.

* * * * *